US012024342B2

(12) United States Patent
Hugo

(10) Patent No.: US 12,024,342 B2
(45) **Date of Patent: *Jul. 2, 2024**

(54) DISPENSER

(71) Applicant: Jennifer Dianne Hugo, Winter Park, FL (US)

(72) Inventor: Jennifer Dianne Hugo, Winter Park, FL (US)

(73) Assignee: Jennifer Hugo, Winter Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/045,339

(22) Filed: Oct. 10, 2022

(65) Prior Publication Data

US 2023/0278760 A1 Sep. 7, 2023

Related U.S. Application Data

(63) Continuation of application No. 17/684,998, filed on Mar. 2, 2022, now Pat. No. 11,498,729.

(51) Int. Cl.
*B65D 47/24* (2006.01)
*B65D 41/04* (2006.01)

(52) U.S. Cl.
CPC ..... *B65D 47/243* (2013.01); *B65D 41/04* (2013.01); *B65D 2251/0025* (2013.01); *B65D 2251/0078* (2013.01); *B65D 2251/20* (2013.01); *B65D 2547/06* (2013.01)

(58) Field of Classification Search
CPC ..... B65D 47/243; B65D 41/04; B65D 2251/0025; B65D 2251/0078; B65D 2251/20; B65D 2547/06; B65D 81/3211
See application file for complete search history.

(56) References Cited

U.S. PATENT DOCUMENTS

| | | | |
|---|---|---|---|
| 502,978 | A | 8/1893 | Lanfair |
| 3,603,469 | A | 9/1971 | Magni |
| 5,038,951 | A | 8/1991 | Rizzardi |
| 5,461,867 | A | 10/1995 | Scudder |
| 5,543,097 | A | 8/1996 | Fang |
| 5,782,345 | A | 7/1998 | Gausch |

(Continued)

FOREIGN PATENT DOCUMENTS

| | | | |
|---|---|---|---|
| EP | 1222122 | B1 | 7/2002 |
| FR | 2453793 | A1 | 11/1980 |

(Continued)

*Primary Examiner* — Vishal Pancholi
*Assistant Examiner* — Robert K Nichols, II
(74) *Attorney, Agent, or Firm* — Nixon Peabody LLP

(57) ABSTRACT

In some embodiments, apparatuses and methods are provided herein useful to dispensers. In some embodiments, a dispenser comprises a main body including an outer wall and an inner wall, the inner wall defining an aperture through the main body; a first seal, wherein the first seal is affixed to the main body and encloses a lower portion of the aperture; a button seated within the aperture and configured to be manipulable between a first position and a second position; a container housed within the button and configured to store a material, wherein when the button is in the second position the container contacts the first seal to allow the material to exit the dispenser; and a second seal, wherein the second seal is affixed to an upper surface of the main body and encloses an upper portion of the aperture.

20 Claims, 5 Drawing Sheets

(56) References Cited

U.S. PATENT DOCUMENTS

| | | | | |
|---|---|---|---|---|
| 6,138,821 | A | 10/2000 | Hsu | |
| 6,148,996 | A | 11/2000 | Morini | |
| 6,832,682 | B1 | 12/2004 | Foster | |
| 7,325,676 | B2 | 2/2008 | Galaz Rodriguez | |
| 7,347,322 | B2 | 3/2008 | Cho | |
| 7,475,774 | B2 | 1/2009 | Clarkson | |
| 7,748,550 | B2 | 7/2010 | Cho | |
| 7,900,787 | B2 | 3/2011 | Oh | |
| 7,951,109 | B2 * | 5/2011 | Anderson | A61J 1/2096 604/416 |
| 11,053,061 | B2 * | 7/2021 | Lee | B65D 51/28 |
| 2002/0096440 | A1 | 7/2002 | Kasuya | |
| 2003/0132244 | A1 | 7/2003 | Birkmayer | |
| 2003/0213709 | A1 * | 11/2003 | Gibler | B65D 51/2842 206/219 |
| 2005/0161348 | A1 | 7/2005 | Morini | |
| 2018/0186529 | A1 | 7/2018 | Tonn | |

FOREIGN PATENT DOCUMENTS

| | | | |
|---|---|---|---|
| FR | 2569660 | A1 | 3/1986 |
| GB | 1479370 | A | 7/1977 |
| GB | 2012714 | A | 8/1979 |
| WO | WO 2001/046035 | A1 | 6/2001 |
| WO | WO 2004/033336 | A1 | 4/2004 |
| WO | WO 2005/023667 | A1 | 3/2005 |

* cited by examiner

DISPENSER

CROSS-REFERENCE TO RELATED APPLICATIONS

This application is a continuation of, and claims priority to, U.S. application Ser. No. 17/684,998, filed on Mar. 2, 2022, which is hereby incorporated by reference herein in its entirety.

TECHNICAL FIELD

This invention relates generally to dispensers and, more specifically, dispensers for use with containers.

BACKGROUND

It is often desirable to mix multiple materials together to form a product. For example, a beverage may contain multiple components that are premixed for the consumer. Unfortunately, in some circumstances, it is desirable to combine a secondary component with a primary component near the time of consumption, as opposed to at the time of production. For example, the primary component may include a fruit juice and the secondary component may include a vitamin powder. To maintain the freshness of the fruit juice it would be preferred to add the vitamin powder at the time of consumption. While it is possible to provide the primary component and secondary component in separate containers, it is cumbersome for the consumer to open the multiple containers and mix the primary and secondary components before consumption. Accordingly, a need exists for an improved dispenser that can aid consumers in mixing multiple components before use.

BRIEF DESCRIPTION OF THE DRAWINGS

Disclosed herein are embodiments of systems, apparatuses, and methods pertaining to dispensers. This description includes drawings, wherein.

Figure 1:
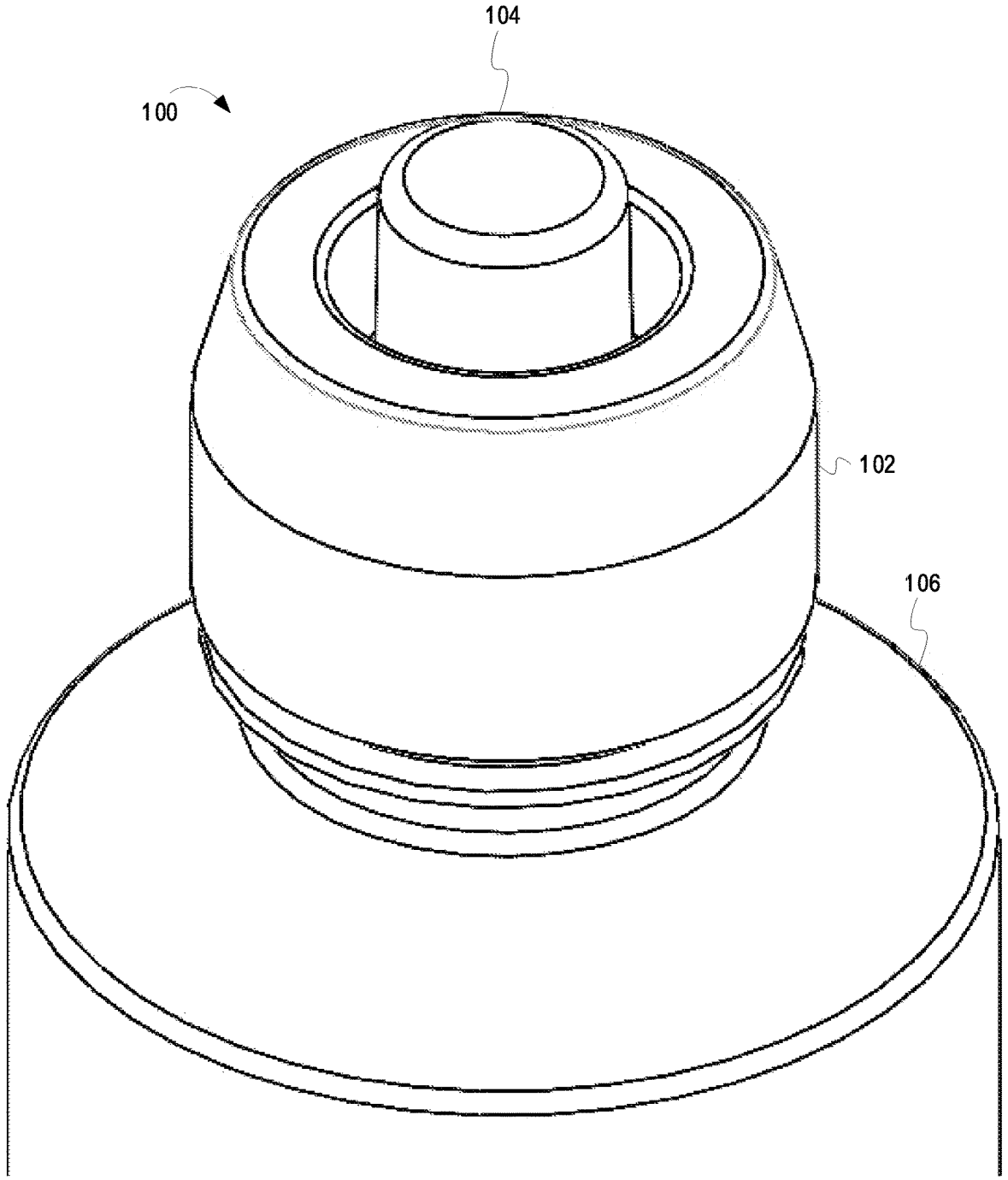
FIG. 1 is a perspective view of dispenser 100 and an external container 106, according to some embodiments.

Elements in the figures are illustrated for simplicity and clarity and have not necessarily been drawn to scale. For example, the dimensions and/or relative positioning of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

Generally speaking, pursuant to various embodiments, systems, apparatuses, and methods are provided herein useful to dispensers. In some embodiments, a dispenser comprises a main body assembly including an outer wall and an inner wall, the inner wall defining an aperture through the main body, a seal, wherein the seal is affixed to the main body and encloses a lower portion of the aperture, a button seated within the aperture and configured to be manipulable between a first position and a second position, and a container housed within the button and configured to store a material, wherein when the button is in the second position the container contacts the seal to allow the material to exit the dispenser.

As previously discussed, it is often desirable to mix multiple components together to form a product. For example, beverages, food items, cleaners, etc. may comprise multiple components. As one example, a beverage may contain a primary component (e.g., juice, water, soda, etc.) and a secondary component (e.g., a powder, liquid, glitter, etc.). Mixing the components at the time of manufacture of the beverage can produce undesirable results. For example, an extended exposure of the primary component to the secondary component may result in degradation of one or both of the primary component and the secondary component, an undesirable taste, settling of the secondary component in the primary component, etc. While it is possible to individually package and/or sell components of a product, doing so is inconvenient for the consumer. Described herein are systems, methods, and apparatuses that seek to minimize, if not eliminate, these drawbacks.

In one embodiment, a dispenser is provided that allows for the easy combination of a material (e.g., a secondary component) with a primary component. The dispenser can be integral with, or securable to, an external container housing a primary component (e.g., a beverage, a cleaning solution, a food product, etc.). The dispenser houses the material and is capable of dispensing the material into the external container. In one embodiment, the dispenser includes a button and a container. The container houses the material, and the material is secured within the dispenser via a seal. The button is manipulable to causes the container to contact the seal and dispense the material into the external container. The discussion of FIG. 1 provides an overview of such a container.

FIG. 1 is a perspective view of dispenser 100 and an external container 106, according to some embodiments. The dispenser 100 allows for a material (e.g., a secondary component) to be administered to a primary component housed within the external container 106. The dispenser 100 includes a main body 102 and a button 104. The main body 102 can be integral with, or secured to, the external container 106. For example, in embodiments in which the dispenser 100 (i.e., the main body 102) is integral with the external container 106, the external container 106 is manufactured to include the dispenser 100. In such embodiments, the dispenser 100 can include a mechanism to allow consumption or use of the primary component and/or the secondary component. Alternatively, in embodiments in which the dispenser 100 can be secured to the external container 106, the dispenser 100 and the external container 106 can be manufactured independently from one another. In such embodiments, the dispenser 100 can be securable to the external 106 In any suitable manner. For example, the dispenser 100 can be threaded onto the external container 106, press-fitted onto the external container 106, clipped onto the external container, adhered to the external container 106, secured to the external container 106 via an interference fit, etc.

Figure 2:
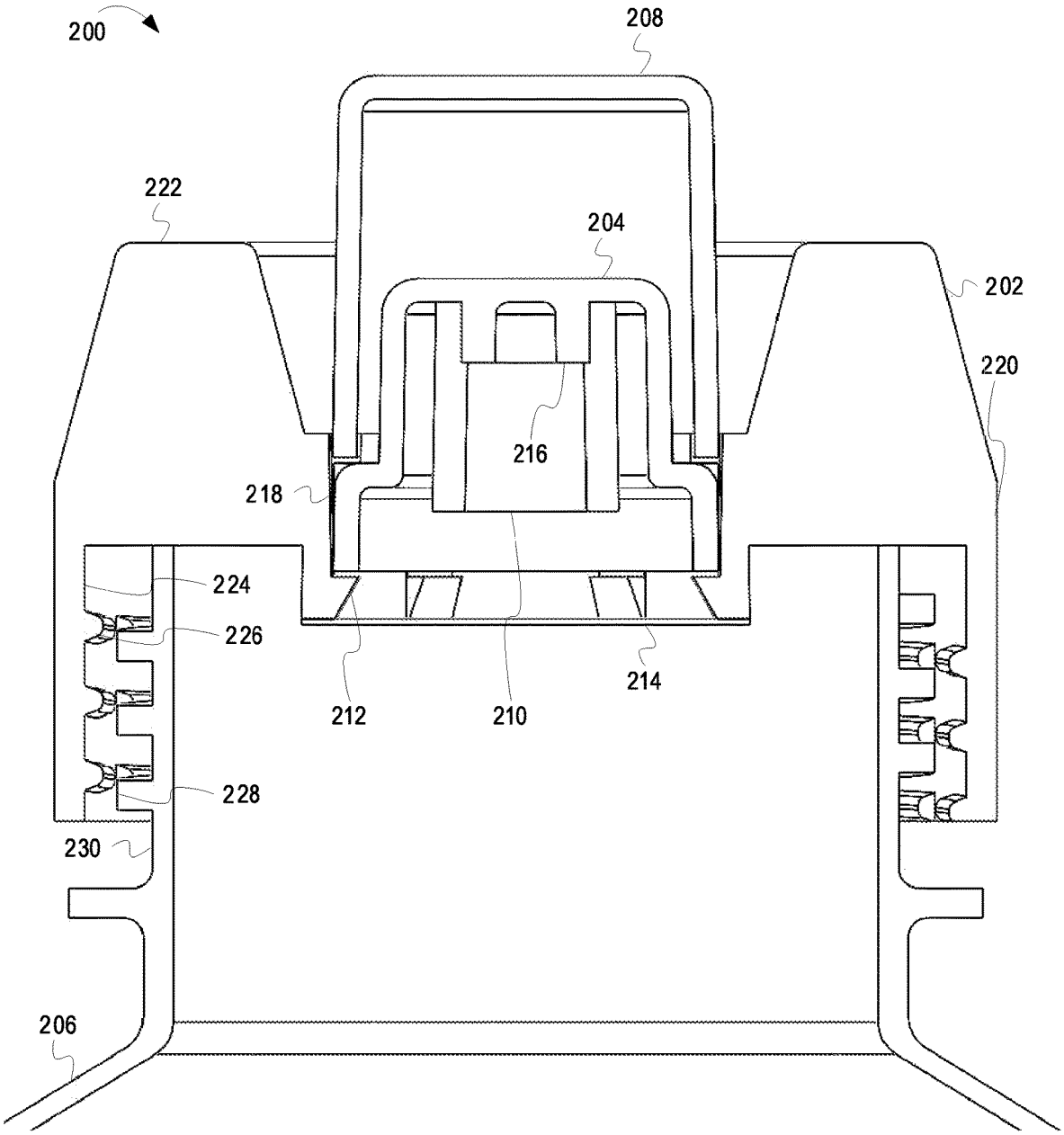
FIG. 2 is a sectional view of a dispenser 200 secured to an external container 206, according to some embodiments.

The button 104 is manipulable to dispense a material housed in the dispenser into the external container 106. For example, as depicted in FIG. 2 (and denoted by reference numeral 210), a container within the dispenser 100 can house the material. The button 104 is manipulable to cause the container to contact a seal (e.g., sever the seal, detach the seal, etc.) so as to allow the material to exit the dispenser 100 and enter the external container 106. The material can be of any suitable state (e.g., a gas, liquid, or solid) and can be of any suitable type (e.g., a consumable item (e.g., a food product or additive, a beverage product or additive, a supplement, etc.), a cleaning item (e.g., a detergent), a decorative item (e.g., glitter, food coloring, etc.), etc.).

While the discussion of FIG. 1 provides an overview of a dispenser capable of dispensing a product into an external container, the discussion of FIG. 2 provides additional detail regarding such a dispenser.

FIG. 2 is a sectional view of a dispenser 200 secured to an external container 206, according to some embodiments. The dispenser includes a main body 202, a button 204, a container 210, and a seal 214. The main body 202 includes an aperture (best seen in, and denoted by reference numeral 332, in FIG. 3) extending through the main body 202. In one embodiment, the main body 202 includes an outer wall 220 and an inner wall 218. In such embodiments, the inner wall 218 defines the aperture. The main body 202 can be made of any suitable material. For example, the main body 202 can comprise plastic, rubber, metal, etc.

The button 204 can be made of any suitable material, such as rubber, plastic, etc. The button 204 is seated within the aperture. For example, in one embodiment and as depicted in FIG. 2, the main body 202 can include a plurality of retentive members 212. The retentive members 212 extend from the main body 202 into the aperture. For example, the retentive members 212 can be located on the inner wall 218. In embodiments that include the retentive members 212, the retentive members 212 can support the button 204 within the aperture. As depicted in the example provided in FIG. 2, the retentive members 212 feature a generally flat upper surface upon which the button 204 seats. The retentive members 212 feature angled sidewalls, as depicted in FIG. 2. The angled sidewalls allow the button 204 to be inserted into the aperture of the dispenser 200 from the bottom.

The button 204 is manipulable from a first position (depicted in FIG. 2) to a second position. In one embodiment, the first position is an extended position and the second position is a compressed position. In embodiments in which the button 204 is comprised of a malleable and/or elastic material, the extended position is a position in which the button 204 is at rest and the compressed position is a position in which the button 204 has been manipulated from its resting position.

The container 210 houses a material. The material can be of any suitable type. The dispenser 200 is configured to dispense the material into an external container 206. The container 210 is housed within the dispenser, for example, within the button 204. As depicted in the example provided in FIG. 2, the button 204 includes a protrusion 216. The container 210 seats on the button 204 via the protrusion 216.

The seal 214 is affixed to the main body 202 and encloses a lower portion of the aperture. That is, the seal 214 physically separates the material in the container 210 from the external container 206. The seal 214 can be of any suitable type (e.g., paper, metallic foil, plastic foil, etc.). Accordingly, the seal 214 can be affixed to the main body 202 via any suitable adhesive.

In some embodiments, and as depicted in FIG. 2, when the button 204 is in the first position, neither the button 204 nor the container 210 contact the seal 214. When the button 204 is in the second position, the container 210 contacts the seal 214. The contact between the container 210 and the seal 214 allows the material housed in the container 210 to exit the dispenser 200 and enter the external container 206. For example, the contact between the container 210 and the seal 214 can sever the seal 214 (or a portion of the seal 214) and/or cause the seal 214 to become at least partially detached from the main body 202. When the seal 214 is severed and/or detaches from the main body 202, the aperture is at least partially open to the external container 206 and the material housed in the container 210 can enter the external container 206. Alternatively, in some embodiments, the container 210 extends to and touches (i.e., contacts) the seal 214 when the button 204 is in the first position. Contact between the container 210 and the seal 214 helps maintain the material within the container 210 prior to manipulation of the button 204. In such embodiments, though the container 210 is contacting the seal 214 when the button is in the first position, the container 210 does not compromise (i.e., sever, detach, etc.) the seal 214. Rather, the manipulation of the button from the first position to the second position causes the container 210 to compromise the seal 214.

In some embodiments, the button 204 can 204 be covered to reduce the likelihood of an unintended manipulation of the button 204. As one example, and as depicted in FIG. 2, the dispenser 200 includes a guard 208. The guard 208 is removably coupled to the dispenser 200 and at least partially covers the button 204. The guard 208 can be shaped and/or dimensioned in any suitable manner. For example, as depicted in FIG. 2, the guard 208 is shaped as a cap that fits within the main body 202 and covers the button 204. As another example, the dispenser 200 can include a second seal. The second seal can be affixed to and upper surface 222 the main body 202 and cover the button 204. The second seal can be made of any suitable material, for example, the second seal can comprise a foil, cardboard covering, plastic covering, etc. In embodiments in which the button 204 is covered (e.g., by the guard 208 and/or a second seal), the user can remove the covering before dispensing the material into the container 206. Additionally, or alternatively, the button 204 can be positioned within the main body 202 to prevent unintended manipulation of the button 204. For example, as depicted in FIG. 2, the button 204 is recessed such that an upper surface of the button does not extend above the upper surface 222 of the main body 302.

As previously discussed, the dispenser 200 can be integral with, or securable to, the external container 206. In the example depicted in FIG. 2, the dispenser 200 is separate from, and securable to, the external container 206. In this example, the dispenser 200 is secured to the external container 206 via a threaded connection. Accordingly, an inner surface 224 of the main body 202 includes first threads 226 and an outer surface 230 of the external container 206 includes second threads 228. The dispenser threads onto, and is secured to, the external container 206 via the first threads 226 and the second threads 228.

Figure 3:
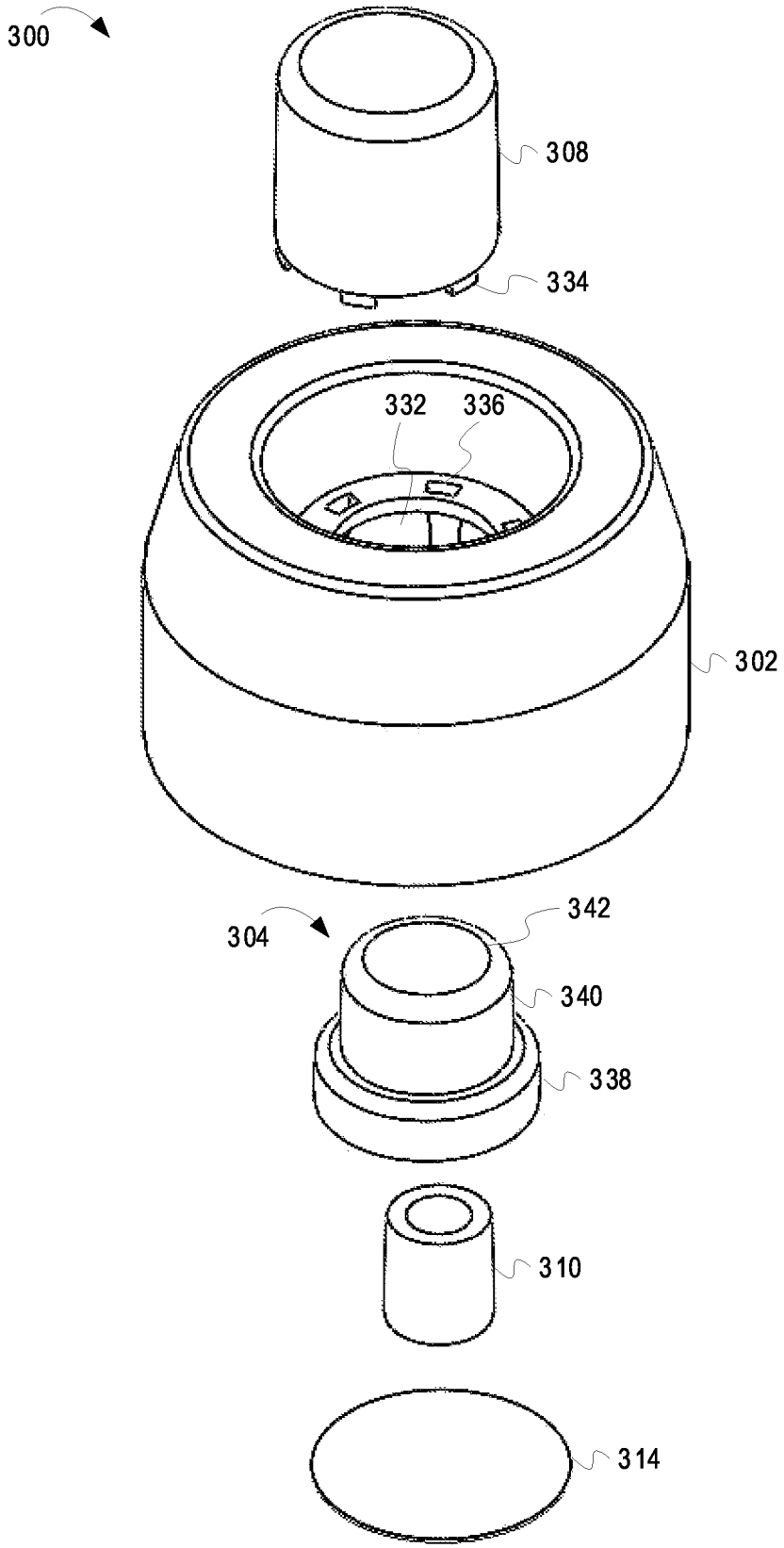
FIG. 3 is an upper exploded view of components of a dispenser 300, according to some embodiments.
Figure 4:
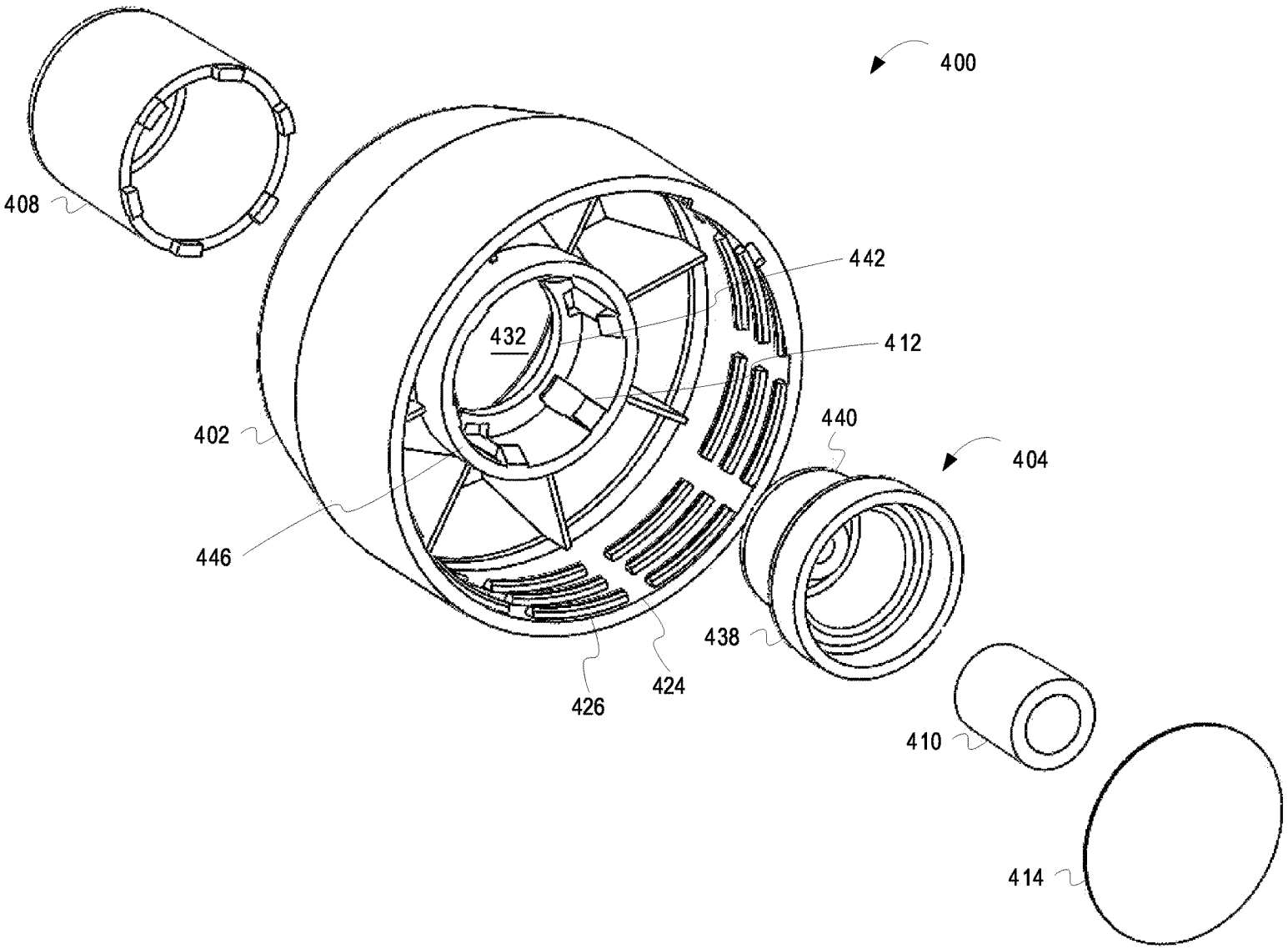
FIG. 4 is a lower exploded view of components of a dispenser 400, according to some embodiments.

While the discussion of FIG. 2 provides additional detail regarding a dispenser capable of dispensing a product into an external container, the discussion of FIGS. 3 and 4 provide additional detail with respect to the components of such a dispenser.

FIG. 3 is an upper exploded view of components of a dispenser 300, according to some embodiments. The dispenser 300 includes a main body 302, a button 304, a container 310, a seal 314, and a guard 308. The main body 302 includes an aperture 332 extending through the main body 302. The button 304 is seated within the aperture 332.

In the example depicted in FIG. 3, the button 304 is generally cylindrically shaped, though such is not required (e.g., the button 304 can take a polygonal shape, semispherical shape, etc.). In the example depicted in FIG. 3, the button 304 comprises a first cylindrical portion 338, a second cylindrical portion 340, and a top 342. The button is manipulable between a first position and a second position.

The container 310 is located within the button 304. In the example depicted in FIG. 3, the container 310 is generally cylindrically shaped, though such is not required (e.g., the container 310 can take a polygonal shape, semispherical shape, etc.). The container 310 houses a material. The material can be of any suitable type (e.g., a food product, a cleaning product, a coloring, etc.). The dispenser 300 is configured to dispense the material into, for example, an external container.

The seal 314 is affixable to the dispenser 300 via the main body 302. In one embodiment, the seal 314 is affixable to a lower portion of the main body 302 and covers the aperture 332. In use, the seal 314 prevents the material from exiting the dispenser 300 until the seal is compromised (e.g., severed, detached from the main body 302, etc.). As previously discussed, the button 304 is manipulable from the first position to the second position. When in the second position (i.e., when the button 304 is being manipulated from the first position to the second position), the container 310 contacts the seal 314. The contact between the container 310 and the seal 314 causes the seal 314 to be compromised, allowing the material to exit the dispenser 300. In one embodiment, a bottom portion of the container 310 (i.e., the portion of the container 310 that contacts the seal 314) can be shaped to encourage severing of the seal 314. For example, the bottom portion of the container 310 can include a sharp or otherwise pointed surface.

The guard 308 is configured to prevent unintended manipulation of the button 304. In the example depicted in FIG. 3, the guard 308 is shaped as a cap that is secured over the button 304. In this example, the guard 308 includes protrusions 334. The protrusions 334 locate in recesses 336 formed in the main body 302. In one embodiment, the protrusions 334 interact with the recesses 336 to secure the guard 308 to the main body 302. For example, the protrusions 334 can include hooks or wedges, and/or be sized to create an interference fit with the recesses 336 to decrease the likelihood of unintended removal of the guard 308.

FIG. 4 is a lower exploded view of components of a dispenser 400, according to some embodiments. The dispenser 400 includes a main body 402, a button 404, a container 410, a seal 414, and a guard 408. The main body 402 includes an aperture 432 that extends through the main body 402. The button 402 seats within the aperture 432. In the example depicted in FIG. 4, the button 402 is generally cylindrical in shape and includes a first cylindrical portion 438 and a second cylindrical portion 440. In some embodiments, the main body 402 includes retentive members 412 and an upper rim 442. The retentive members 412 and the upper rim 442 extend from an inner surface of the main body 402. In such embodiments, the button 402 seats within the aperture 432 such that the first cylindrical portion 438 is secured between the retentive members 412 and the upper rim 442 of the main body 402 while the second cylindrical portion 440 extends beyond the upper rim 442 of the main body 402. The retentive members 412 aid in preventing the button 402 to be pushed through the aperture 432 during manipulation of the button 402.

The seal 414 is securable to a lower edge 446 of the main body 402, enclosing a lower portion of the aperture 432. The container 410 is configured to house a material. The container 410 locates within the button. When the button 402 is manipulated from a first position to a second position, the container 410 contacts the seal 414. Contact between the container 410 and the seal 414 causes the seal 414 to be severed and/or detach from the lower edge 446 of the main body 402. When the seal 414 is severed and/or detached from the lower edge 446 of the main body 402, the material within the container 410 can exit the dispenser 400.

In some embodiments, the dispenser 400 is a separate from, and securable to, an external container. In such embodiments, the dispenser 400 includes a fastening mechanism. In the example depicted in FIG. 4, the fastening mechanism includes threads 426. The threads 426 are located on a surface 424 of the main body and are configured to interact with corresponding threads of the external container.

Figure 5:
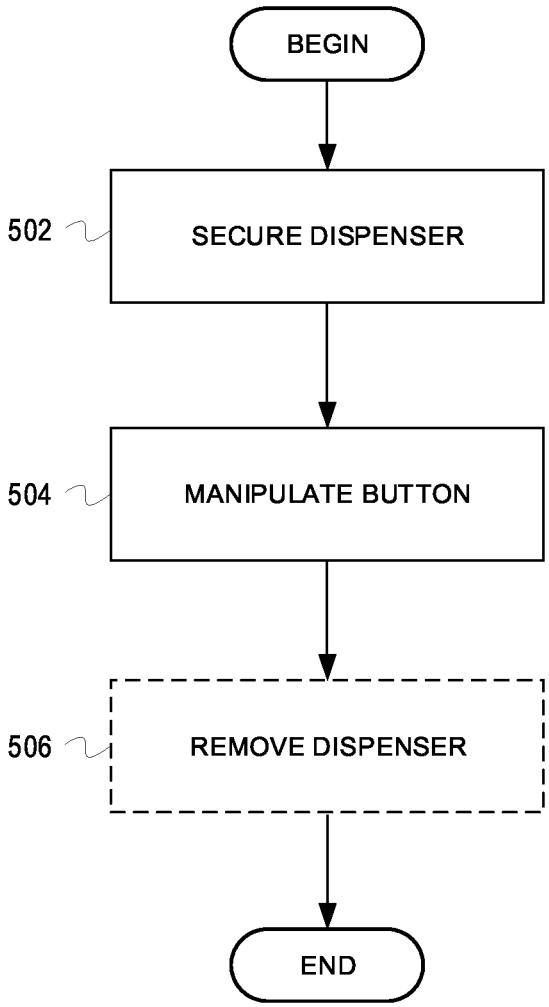
FIG. 5 is a flow chart depicting example operations for dispensing a material into an external container, according to some embodiments.

While the discussion of FIGS. 1-4 describe a dispenser the discussion of FIG. 5 provides additional detail regarding use of such a dispenser.

FIG. 5 is a flow chart depicting example operations for dispensing a material into an external container, according to some embodiments. The flow begins at block 502.

At block 502, a dispenser is secured to an external container. The dispenser can be secured to the external container by a user (i.e., the dispenser is separate from the external container) or secured to the external container during manufacture of the external container and/or the dispenser. Additionally, in some embodiments, the dispenser is secured to the external container at the time of manufacture, as the dispenser is integral with the container. The dispenser generally includes a main body, a button, a container, and a seal. The main body includes an aperture extending therethrough, and the button seats within the aperture. The container is configured to house a material and seats within the button. The seal is affixed to the main body and encloses a lower portion of the aperture. The dispenser can be secured to the external container via any suitable fastening mechanism. For example, the dispenser can be threaded onto the external container, press-fitted onto the external container, clipped onto the external container, adhered to the external container, secured to the external container via an interference fit, etc. The flow continues at block 504.

At block 504, the button is manipulated. For example, the user can manipulate the button. The button is manipulable from a first position to a second position. When the button is manipulated from the first position to the second position, the container contacts the seal, causing the seal to be severed and/or detached from the main body. When the seal is severed and/or detached from the main body, the material housed in the container is dispensed into the external container. Optionally, the flow continues at block 506.

At block 506, the dispenser is removed from the external container. For example, the user can remove the dispenser before consuming and/or using the product housed in the external container.

In some embodiments, a dispenser comprises a main body assembly including an outer wall and an inner wall, the inner wall defining an aperture through the main body, a seal, wherein the seal is affixed to the main body and encloses a lower portion of the aperture, a button seated within the aperture and configured to be manipulable between a first position and a second position, and a container housed within the button and configured to store a material, wherein when the button is in the second position the container contacts the seal to allow the material to exit the dispenser.

In some embodiments, a dispenser for dispensing a material into an external container comprises a main body including an aperture extending through the main body, the main body configured to be secured to the external container, a seal affixed to the main body and covering a lower portion of the aperture, a button located within the aperture and configured to be manipulated from an extended position to a compressed position, and a container housed within the button and configured to store the material, wherein when the button is in the compressed position the container contacts the seal to allow the material to be dispensed into the external container.

In some embodiments, an apparatus and a corresponding method performed by the apparatus, comprises securing, to an external container, a dispenser, the dispenser comprising a main body including an aperture extending through the main body, the main body configured to be secured to the external container, a seal affixed to the main body and covering a lower portion of the aperture, a button located within the aperture and configured to be manipulated from an extended position to a compressed position, and a container housing within the button and configured to store the material, and depressing the button from the extended position to the compressed positioned, wherein the depressing the button from the extended position to the compressed position causes the container to contact the seal and dispense the material into the external container.

Those skilled in the art will recognize that a wide variety of other modifications, alterations, and combinations can also be made with respect to the above described embodiments without departing from the scope of the disclosure, and that such modifications, alterations, and combinations are to be viewed as being within the ambit of the inventive concept.

What is claimed is:

1. A dispenser comprising:

a main body including an outer wall, an inner wall, and an upper surface disposed between the outer wall and the inner wall, the inner wall defining an aperture through the main body, wherein the inner wall includes an upper rim that is recessed relative to the upper surface, and wherein a portion of the inner wall between the upper rim and the upper surface tapers away from the button, thereby making the aperture larger at the upper surface than at the upper rim;

a first seal, wherein the first seal is affixed to the main body and encloses a lower portion of the aperture;

a button comprising an elastic material, the button seated within the aperture, wherein the button extends beyond the upper rim but is recessed relative to the upper surface, and wherein the button is configured to be manipulable between a first position and a second position, wherein the first position is an extended position and the second position is a compressed position wherein a bottom surface of the button remains above the first seal;

a container housed within the button and configured to store a material, wherein when the button is in the second position the container contacts the first seal to allow the material to exit the dispenser;

wherein, when the button is in the first position, the container does not extend below the bottom surface of the button.

2. The dispenser of claim 1, further comprising:

a guard removably attached to the upper rim to at least partially cover the button, wherein the upper rim comprises recesses that mate with protrusions on the guard.

3. The dispenser of claim 2, wherein the guard is recessed relative to the upper surface.

4. The dispenser of claim 1, wherein the button seats between the upper rim and the first seal.

5. The dispenser of claim 1, wherein an inner surface of the outer wall includes threads, wherein the threads are configured to mate with an external container to secure the dispenser to the external container.

6. The dispenser of claim 1, wherein the container one or more of severs the first seal when the button is in the second position and at least partially detaches the first seal from the main body when the button is in the second position.

7. The dispenser of claim 1, wherein the button includes a protrusion, and wherein the container seats on the button via the protrusion.

8. The dispenser of claim 7, wherein the button and the protrusion are monolithically formed from the elastic material.

9. The dispenser of claim 1, wherein the first seal is one or more of a foil, a cardboard covering, and a plastic covering.

10. A dispenser comprising:

a main body including an outer wall, an inner wall, and an upper surface disposed between the outer wall and the inner wall, the inner wall defining an aperture extending through the main body, wherein the inner wall includes a plurality of retentive members, wherein each retentive member of the plurality of retentive members includes a flat upper surface and an angled sidewall;

a first seal affixed to the main body and covering a lower portion of the aperture;

a button comprising an elastic material, the button located within the aperture, wherein the button is seated on the flat upper surfaces of the plurality of retentive members, and wherein the button is configured to be manipulated from an extended position to a compressed position wherein a bottom surface of the button remains above the plurality of retentive members;

a guard removably attached to the main body to at least partially cover the button, wherein the main body comprises recesses that mate with protrusions on the guard;

a container housed within the button and configured to store the material, wherein when the button is in the compressed position the container contacts the first seal to allow the material to exit the dispenser;

wherein, when the button is in the extended first position, the container does not extend below the bottom surface of the button.

11. The dispenser of claim 10, wherein:

a portion of the inner wall above the plurality of retentive members tapers away from the button, thereby making the aperture larger at the upper surface than at the plurality of retentive members.

12. The dispenser of claim 10, wherein:

the button includes a protrusion, wherein the container seats on the button via the protrusion, and wherein the button and the protrusion are monolithically formed from the elastic material.

13. The dispenser of claim 10, wherein the container one or more of severs the seal when the button is in the second position and at least partially detaches the seal from the main body when the button is in the second position.

14. The dispenser of claim 10, wherein the guard is recessed relative to the upper surface.

15. A method for dispensing a material into an external container, the method comprising:

providing a dispenser secured to the external container, the dispenser including:

a main body including an outer wall, an inner wall, and an upper surface disposed between the outer wall and the inner wall, the inner wall defining an aperture extending through the main body, the main body configured to be secured to the external container, and wherein the inner wall includes an upper rim that is recessed relative to the upper surface, a seal affixed to the main body and covering a lower portion of the aperture, a button comprising an elastic material, the button located within the aperture, wherein the button extends beyond the upper rim but is recessed relative to the upper surface, and wherein the button is configured to be manipulated from an extended position to a compressed position wherein a bottom surface of the button remains above the first seal, a guard removably attached to the upper rim to at least partially cover the button, wherein the upper rim comprises recesses that mate with protrusions on the guard; and a container housed within the button and configured store the material, wherein when the button is in the extended position, the container does not extend below the bottom surface of the button; and removing the guar; and manipulating the button from the extended position to the compressed position, wherein depressing the button from the extended position to the compressed position causes the container to extend below the bottom surface of the button to contact the first seal and dispense the material into the external container.

16. The dispenser of claim 15, wherein the first seal is one or more of a foil, a cardboard covering, and a plastic covering.

17. The dispenser of claim 15, wherein a portion of the inner wall between the upper rim and the upper surface tapers away from the button, thereby making the aperture larger at the upper surface than at the upper rim.

18. The dispenser of claim 15, wherein the button includes a protrusion, and wherein the container seats on the button via the protrusion.

19. The dispenser of claim 15, wherein the button and the protrusion are monolithically formed from the elastic material.

20. The method of claim 15, wherein the guard is recessed relative to the upper surface.

* * * * *